United States Patent [19]

Crawford et al.

[11] 4,055,203

[45] Oct. 25, 1977

[54] LOOSE FILL CELLULOSE INSULATION MATERIAL PACKING MACHINE

[75] Inventors: G. Roger Crawford; Duane Sanders; David B. Shill, all of Spokane, Wash.

[73] Assignee: Thermoguard Insulation Co., Spokane, Wash.

[21] Appl. No.: 640,073

[22] Filed: Dec. 12, 1975

[51] Int. Cl.[2] ..... B30B 15/30; B65B 1/20

[52] U.S. Cl. ..... 141/73; 100/90; 100/215; 141/271

[58] Field of Search ..... 53/24, 124 B; 100/215, 100/90; 141/10, 12, 69, 71, 72, 73, 80, 114, 129, 270, 271, 281, 282, 283, 316, 317, 372, 390, 166; 222/238

[56] References Cited

U.S. PATENT DOCUMENTS

| | | | |
|---|---|---|---|
| 3,548,890 | 12/1970 | Langen | 100/90 X |
| 3,563,168 | 2/1971 | Doninger | 141/73 X |
| 3,613,559 | 10/1971 | Buisson | 141/71 X |
| 3,785,410 | 1/1974 | Carter | 141/316 X |
| 3,879,150 | 4/1975 | Brown | 222/238 X |

*Primary Examiner*—Richard E. Aegerter
*Assistant Examiner*—Frederick R. Schmidt
*Attorney, Agent, or Firm*—Wells, St. John & Roberts

[57] ABSTRACT

A machine for packing compressible low density loose fill cellulose insulation material into flexible bags. A machine includes a hopper for receiving bulk quantities of loose fill insulation material. A metered feed mechanism is sequentially operable to discharge measured amounts of the loose insulation material from the hopper to an upright charging tube. Below the tube is mounted a container receiving mechanism and a container enclosure mechanism. Empty flexible insulation receiving bags are mounted to the receiving mechanism and located in position directly below the charging tube. The enclosure mechanism is operated to close about the periphery of the empty container while a compactor mechanism operates to compress the preselected amount of insulation into the waiting container. Once the container is packed, the enclosure mechanism opens to allow the filled container to be removed and an empty container mounted in its place.

9 Claims, 10 Drawing Figures

94
23
110
96
107
109
98
95
11
95
33
32
31
10
27
13
28
105
104
27
17
34
15
36
38
37
58
60
59
110
111
56
7
7
52
52
8
51
50
50
19
19
51
8
5
108
5
65
67
66
68
70
21
69
69

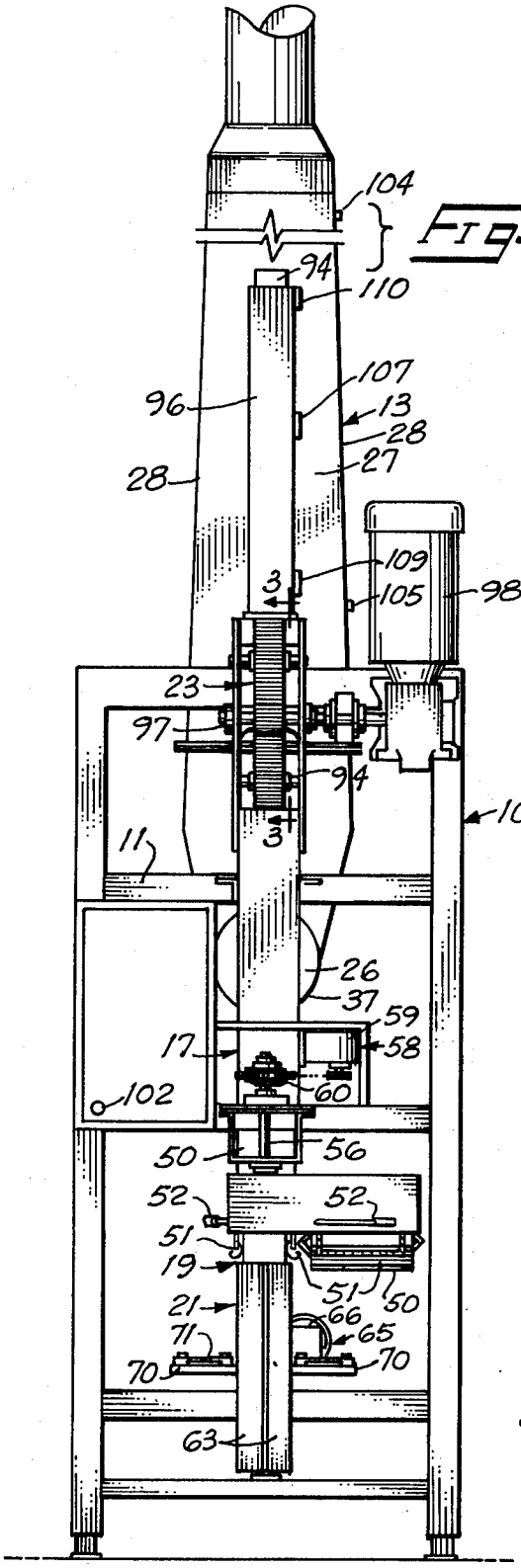
FIG. 2
FIG. 3
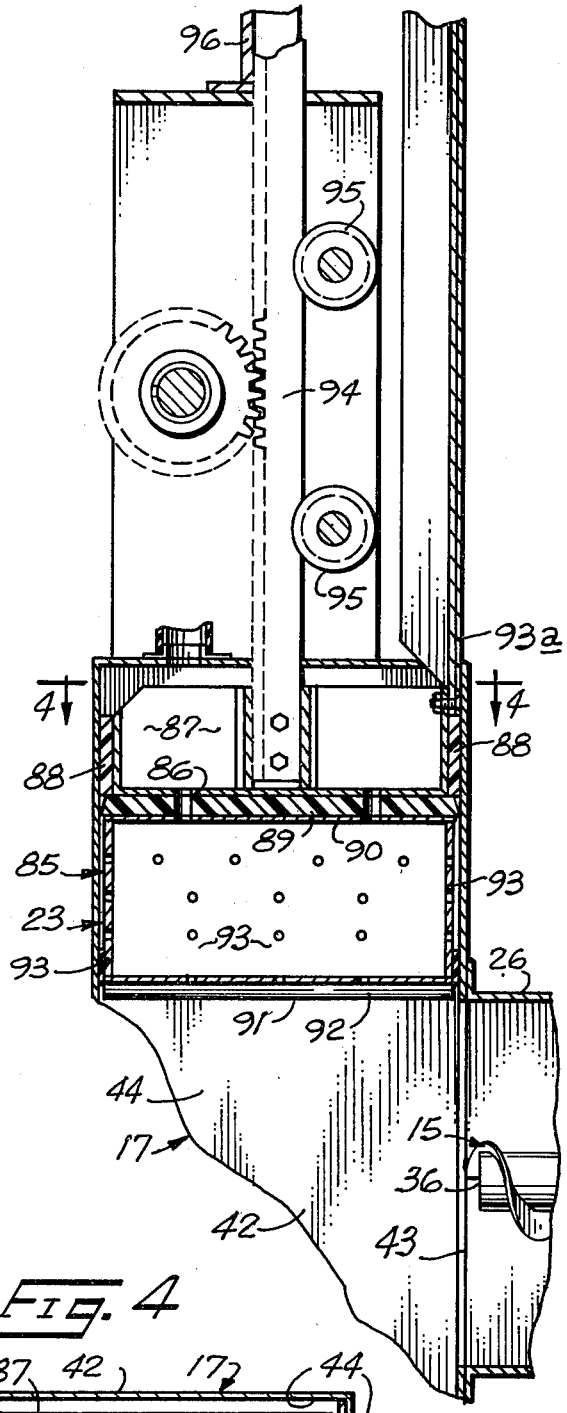
FIG. 4
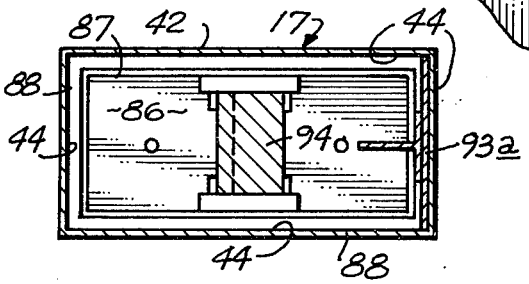

LOOSE FILL CELLULOSE INSULATION MATERIAL PACKING MACHINE

BACKGROUND OF THE INVENTION

The present invention relates to loose fill insulation material packing machines and more particularly to such machines utilized to pack a low density loose fill cellulose insulation material into flexible bags.

It is a difficult process to pack relatively low density cellulose insulation material into receiving bags. The problem arises from the fact that the cellulose insulation material is by nature extremely light weight (weighing approximately one half pound per cubic foot) and formed of independent short fibers. It is not unusual that this light weight material will bridge across an ordinary upright hopper with no support below other than the frictional engagement between the bridged volume of material and the hopper walls. It may therefore be understood that handling of such material is a rather difficult procedure and requires equipment especially designed to avoid an occurance at which the material will bridge across a hopper or a delivery tube opening to thereby halt its progress toward a delivery station or a filling station.

In addition, such light weight material as low density cellulose insulation is necessarily bulky by nature. It is therefore desirable to provide some means of compacting this material while it is being packaged to reduce the storage volume requirement that would ordinarily be prohibitive. Such low density loose fill cellulose insulation material lends itself well to compaction within relatively any container. However, to provide an efficient means for holding compacted cellulose insulation, flexible plastic bags have been found to be preferable. Such bags do not substantially increase the compacted volume of the cellulose material held therein nor do they substantially add to the total weight of the product. A problem, however, has been to produce a machine that will successfully fill and compact cellulose insulation material within such a flexible platic bag.

A known type of cellulose fiber insulating packing machine utilizes a horizontal auger to feed the material directly into a waiting bag. Other machines utilize a horizontally disposed ram to push the material into a bag. These machines, while somewhat effective, are slow and cumbersome. Part of the difficulty is that the bags must be held longitudinally open while being filled. This is a difficult task and often results in torn bags. Another difficulty is that the bags, when filled horizontally, do not retain a uniform shape and are therefore difficult to stack for storage purposes.

It has been found that if cellulose fiber type insulation is packed into upright bags held open within a mold, the result is uniformly packed bags of consistent dimension and weight. Also, bags filled in an upright condition within a mold are less likely to burst while being filled.

One object of the present invention is to provide an apparatus for packing loose fill cellulose insulation material into flexible containers that includes appropriate and effective means for preventing bridging of the cellulose material as the material is delivered to a packaging loction.

Another object of the present invention is to provide such a machine that will enable compaction of the cellulose material within a flexible bag without damaging the bag.

A further object is to provide such a machine that will pack equal amounts of material in successive bags and that will produce a uniform filled bag configuration.

Another object is to provide such a machine that will quickly and efficiently fill successive upright open flexible containers with premeasured amounts of cellulose insulating material.

A still further object is to provide such an apparatus that is relatively simple in design, easy to manufacture, and inexpensive to operate.

These and still further objects and advantages will become apparent upon reading the following description which, taken with the accompanying drawings, disclose a preferred form of the present invention. It is to be noted that the disclosure and drawings contained herein are simply illustrative of a preferred form of the present invention and that other modified forms thereof may be easily devised by those skilled in the art to which this invention pertains. It is therefore intended that only the following claims be taken as restrictions upon the scope of the present invention.

BRIEF DESCRIPTION OF THE DRAWINGS

A preferred form of the present invention is illustrated in the accompanying drawings in which:

FIG. 2 is a front elevational view of the machine as seen from the left in FIG. 1;

FIG. 3 is an enlarged fragmentary sectional view taken substantially along line 3—3 in FIG. 2;

FIG. 4 is a section view taken along line 4—4 in FIG. 3;

DETAILED DESCRIPTION OF A PREFERRED EMBODIMENT

Figure 1:
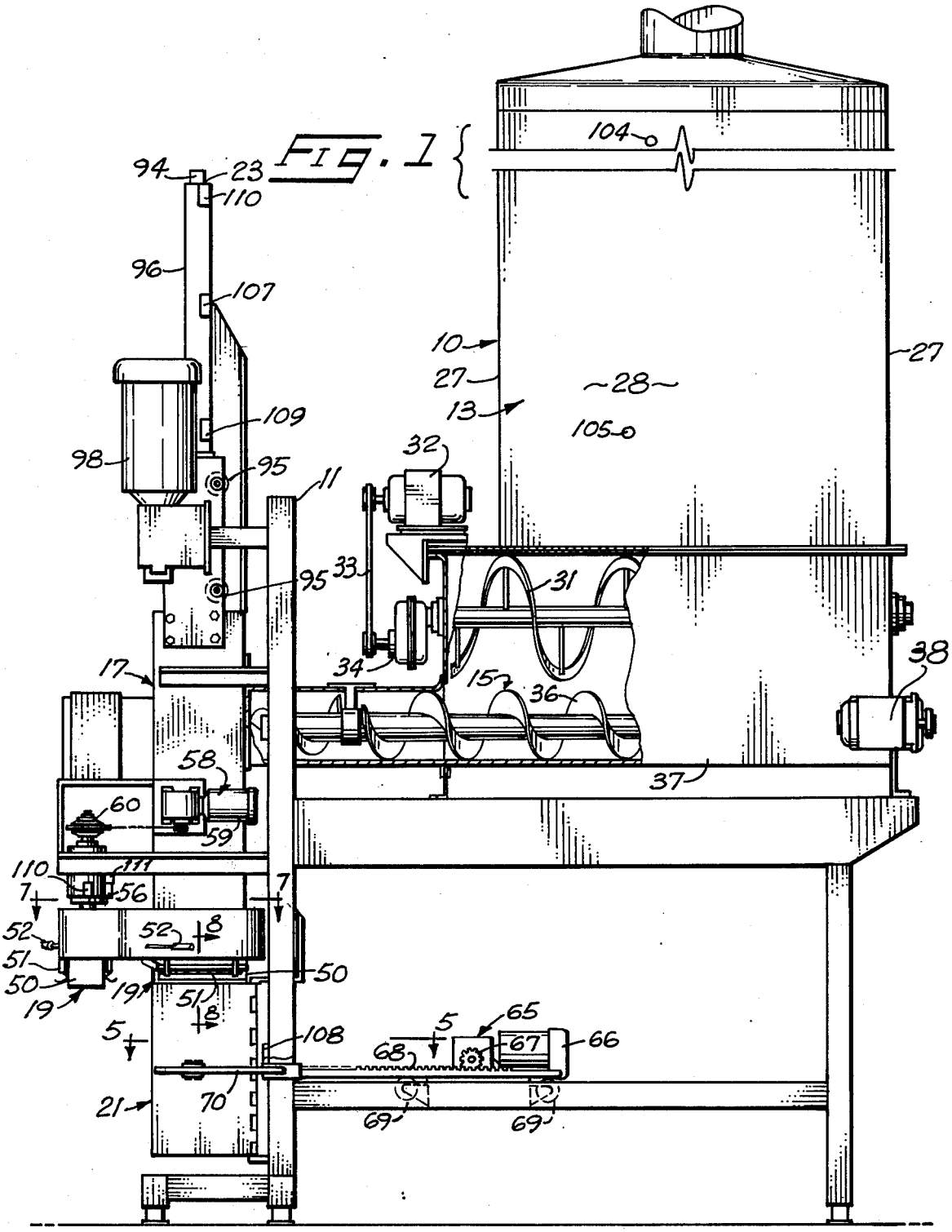
FIG. 1 is a side elevational view of the present machine.
Figure 9:
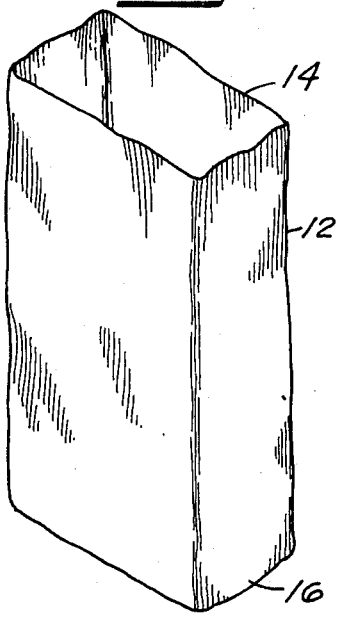
FIG. 9 is a pictorial view of a bag for receiving cellulose insulation material from the present machine.

A preferred form of the present invention is illustrated in FIGS. 1 and 2 of the accompanying drawings and is designated therein by the reference numeral 10. As shown, machine 10 includes an external supportive framework 11. A hopper 13 is mounted on framework 11 for receiving bulk cellulose insulation material. Also included are a material delivery means 15 for delivering preselected amounts of the material to an upright charging tube 17. Also included within the basic composition of machine 10 is a container receiving means 10 that is operative to hold successive empty flexible containers 12 (FIG. 9) open below the charging tube 17. An enclosure means 21 is provided directly below charging tube 17 to enclose and provide a peripheral support for the containers 12 as they are filled with the insulation material. A compactor means 23 is provided to compress the material held within charging tube 17 downwardly into the container below.

Figure 10:
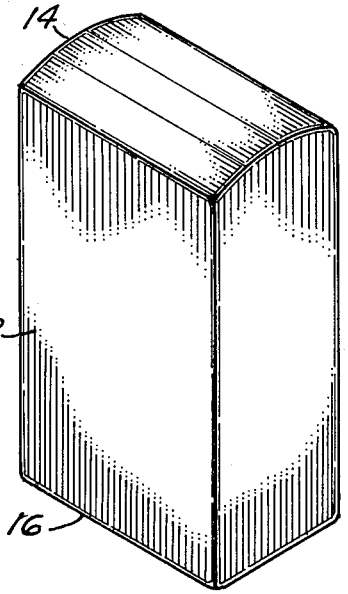
FIG. 10 is a pictorial view of a bag after being filled with cellulose insulation material by the present machine.

The containers 12 are thin walled plastic bags having an open end 14 and a closed end 16. The plastic material is somewhat deformable in order to conform to a "mold" provided by the enclosure means when being filled with compressed insulation material. A filled bag is shown in FIG. 10.

Looking now at the drawings in greater detail, the hopper 13 is shown in FIGS. 1 and 2 as being upwardly connected to a material feed means (not shown). The hopper 13 includes end walls 27 and side walls 28 that form a rectangular cross sectional configuration. It should be noted that the side walls 28 diverge downwardly toward the material delivery means 15. The divergence of side walls 28 serves to prevent bridging of material loosely held within the hopper 13 as it moves downwardly therein toward the delivery means 15. Therefore, no additional means for downward pushing or pressuring the bulk material held within hopper 13 is necessary.

Material delivery means 15 is shown in detail in FIG. 1. Means 15 includes a ribbon screw blender 31 rotated by a motor 32 to rotate within hopper 13 during each operational cycle to assure that a constant supply of material will be delivered to a feed screw 36 located below. The ribbon screw blender 31 is driven through motor 32 by a belt 33 and a reduction unit 34. Motor 32 is operated while the machine is in operation to agitate and assure a constant supply of material to be delivered to charging tube 17.

Feed screw 36 is located directly below ribbon screw 31 and is rotatable about a substantially horizontal axis. Feed screw 36 is rotatably journaled by hopper 13 and is carried within a complementary curved portion 37 of the hopper 13. A metered amount of material may be delivered from the hopper through a delivery duct 26 simply by rotating feed screw 36 at a constant speed for a preselected time. The feed screw 36 is driven by a motor 38. It is assured that selected time operation of feed screw 36 will result in delivery of a predictable amount of material to the charging tube 17 through the provisions of hopper 13 and ribbon screw blender 31.

Figure 8:
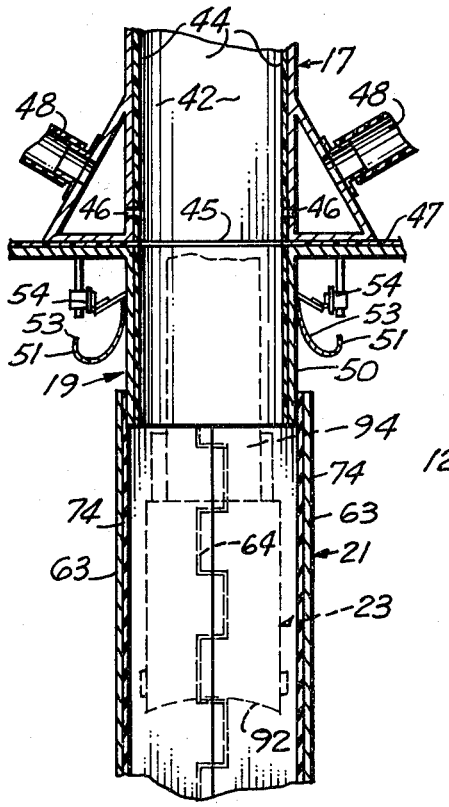
FIG. 8 is an enlarged section view taken substantially along line 8—8 in FIG. 1.

The upright charging tube 17 is illustrated in detail by FIGS. 1 through 4 and 8. Charging tube 17 includes a hollow upwardly elongated charging chamber 42. Chamber 42 is rectangular in cross section as may be noted in FIG. 4. Chamber 42 opens into the delivery duct 26 at a rectangular infeed opening 43. Duct 25 is therefore transformed from the circular infeed opening at the hopper 13 to the rectangular opening 43 to chamber 42. The charging chamber 42 includes upright walls 44 that extend downwardly to an open discharge end 45 (FIG. 8). Adjacent the discharge end 45 is provided a plurality of air escape holes 46 that enable escape of air as the material is compressed into containers awaiting below. A slight vacuum pressure may be applied through tubes 48 connected through holes 46 to chamber 42 to assure removal of airborne particles and excess air therein. Adjacent the discharge 45 is provided a bearing surface 47 that will slide freely over the container receiving means 19.

Figure 7:
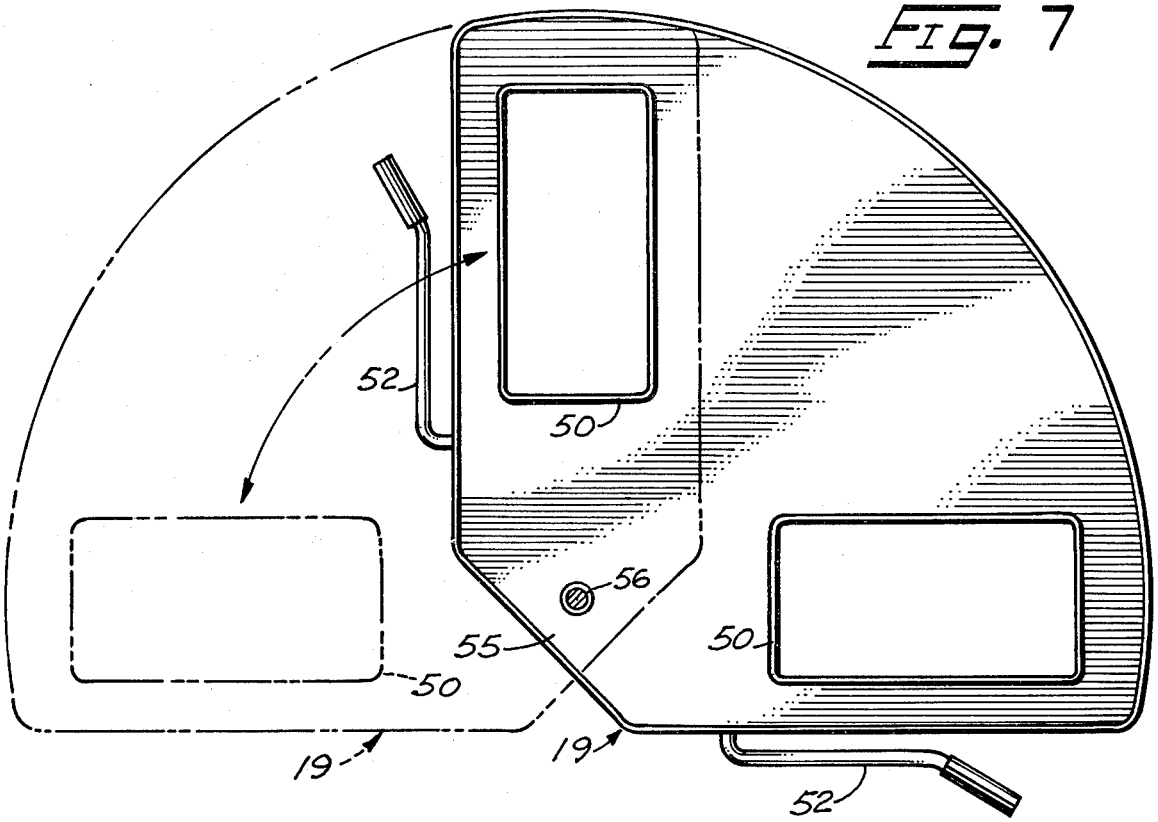
FIG. 7 is an enlarged section view taken substantially along line 7—7 in FIG. 1.

Container receiving means 19 is illustrated in particular by FIGS. 1, 7 and 8. Means 19 includes two angularly spaced bag receiving chutes 50 that are held for rotation on a pivotable table 55. This table 55 is mounted through a pivot shaft 56 to the machine framework 11. A drive means 58 is operatively connected to table 55 to selectively rotate chutes 50 between a filling position wherein the appropriate chute is located directly below charging tube 17, and either of two container loading or unloading stations. Drive means 58 includes a motor 59 that is connected through a sprocket and chain assembly 60 to the pivot shaft 56. Motor 59 is reversible to enable pivotal movement of means 19 between the positions illustrated by solid and phantom lines respectively in FIG. 7.

Successive bags 12 are held upwardly open on chutes 50 by bag clamping assemblies 51. These assemblies are simply comprised of hinged over-center clamp plates 53 (FIG. 8) that normally rest against the chute sides. The hinges 54 that support plates 53 are located below the point of contact between the plates and chutes 50. When a bag is pulled upwardly over the chute between the plates 53 and chute sides, the plates pivot slightly outwardly. Then when the bag is released or starts to slide downwardly, the plates swing back against the bag material to clamp it to the chute. A manually operable lever mechanism 52 is provided to facilitate release of the bags by moving the plates away from clamping engagement with the bag and chute sides. Mechanical means may also be employed to enable automatic or semiautomatic gripping and releasing of the bags.

Figure 5:
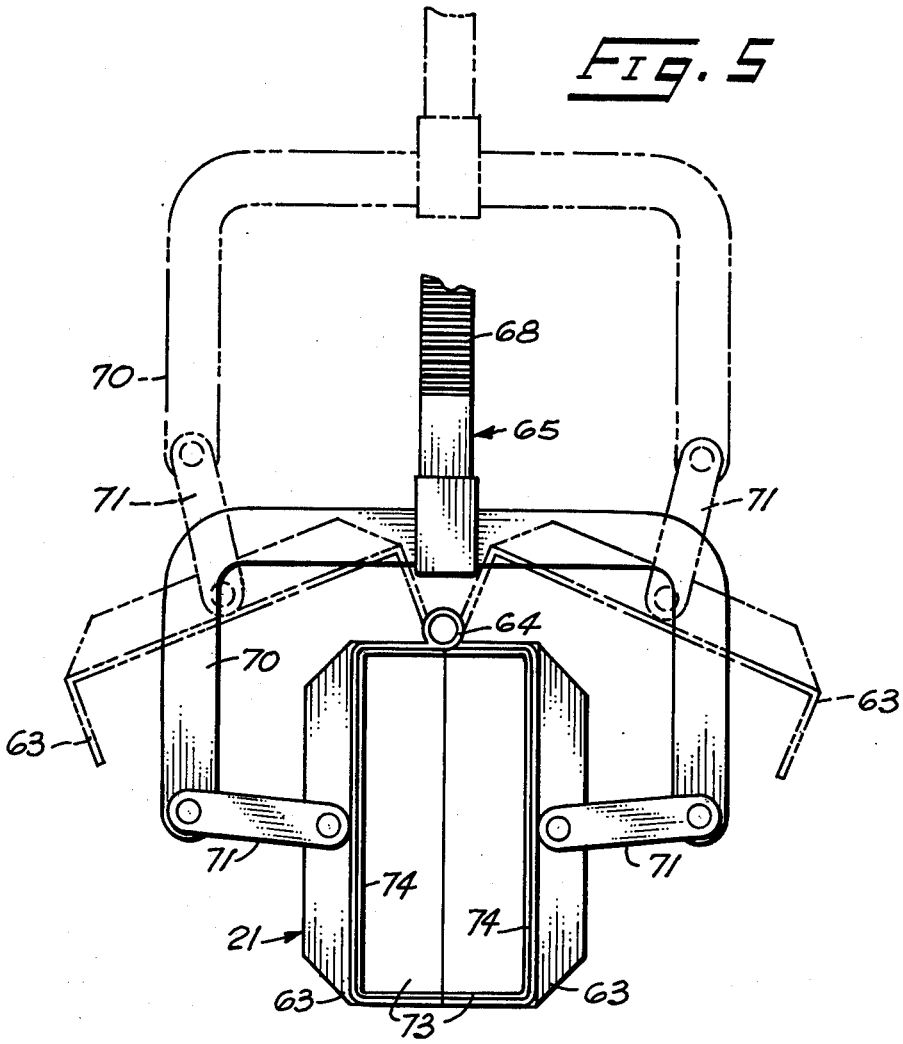
FIG. 5 is a fragmentary enlarged section view taken substantially along line 5—5 in FIG. 1.
Figure 6:
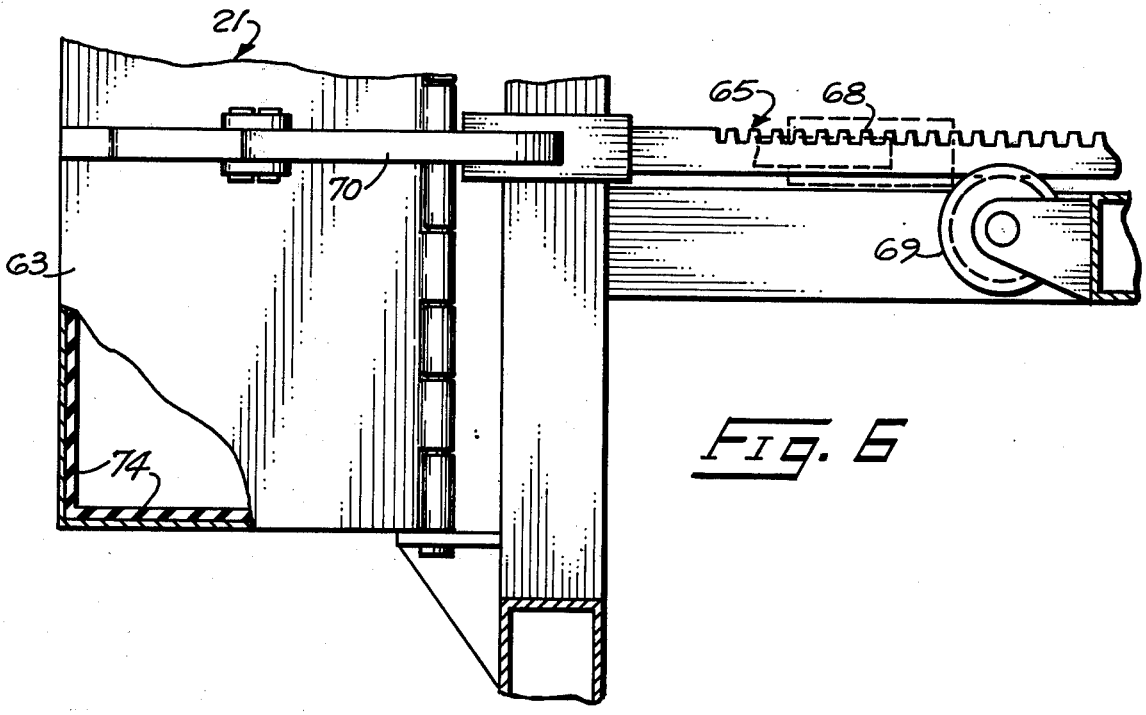
FIG. 6 is a fragmentary side elevational view showing the elements illustrated by FIG. 5 in side elevation.

Enclosure means 21 is illustrated in detail by FIGS. 5 and 6. Specifically, the enclosure means 21 includes a pair of hinged clam plates 63 and enclosure floor 73. Plates 63 and floor sections 73 serve to close and form a "mold" into which the bags are formed due to the compaction of cellulose material therein.

Clam plates 63 are shown in detail by FIG. 5. Plates 63 are pivotably joined by a hinge 64. Hinge 64 defines an upright pivot axis about which the plates 63 pivot in opposite directions. A means 65 is provided for pivoting the clam plates 63 between a closed and open position (as shown in FIG. 5 by solid and phantom lines respectively). Means 65 is comprised of an electric motor 66 that drives a pinion 67. The pinion 67 meshes with the gear teeth along an elongated rack 68. Longitudinally spaced rollers 69 are rotatably mounted on framework 11 to support rack 68 for movement in response to rotation of pinion 67.

A yoke 70 is fastened to a forward end of rack 68. Yoke 70 is connected to the clam plates 63 by pivot links 71. Each link 71 connects an end of yoke 70 to a clam plate 63. Retraction of the rack 68 and yoke 70 results in pivotal movement of clam plates 63 to an open condition. Forward movement of rack 68 then results in closing of the clam plates 63 about the periphery of a bag held therebetween.

The enclosure floor 73 is best illustrated by FIG. 6. Floor 72 is fixed to the bottom portions of clam plates 63 to provide bottom support for the bags. The entire interior surface of each clam plate 63 and floor 73 is covered by a resilient material 74 to cushion the bags as they are being filled.

Upright compactor means 23 is illustrated in particular detail in FIGS. 3 and 4 of the drawings. Means 23 includes a piston 85 that is vertically movable within the charging chamber 42. Piston 85 is comprised of a mounting plate 86 that is complementary in configuration to the internal cross sectional configuration of chamber 42. Plate 86 includes upright side walls 87 that are provided with low friction guide surfaces 88 that enable relatively free sliding movement of the piston 85 vertically within chamber 42. A resilient pad 89 is provided along the bottom surface of plate 86. A metal plate 90 is then provided at the base of pad 89 mounting a ram head 91 that is employed to engage and compress the cellulose material downwardly into a waiting container. The ram head 91 includes an arcuate ram surface 92 (FIGS. 3 and 8) that is held downward from plate 86 by upright perforated side walls 93. Surface 92 is also perforated along with walls 93 to enable escape of air from the compressing material as it is compacted into a bag.

An aperture plate 93*a* is mounted to one side of piston 85 to slide vertically along a charging chamber 42 and selectively cover opening 43. Therefore, when piston 85 is in a downward position, aperture plate 93*a* will cover infeed 43 to prevent any insulation material from dropping on top of piston 85.

Piston 85 is moved vertically within the charging chamber 42 by means of a rack 94, a motor 98, and a pinion 97. The rack 94 is held for movement along a vertical path by a pair of rollers 95 on one side and a guide way 96 on an opposite side. Motor 98 and pinion 97 are shown in FIG. 2.

Control of the operational sequence of the above-described machine is accomplished through conventional switching arrangements. Control is provided from a central panel 101 which provides a starting switch 102 for actuation by an operator. Switch 102 is utilized to start an operational cycle of the machine. Two switches 104 and 105 on the hopper 13 will govern operation of the machine so that when the hopper is empty, the machine will not operate and, when the hopper is full, the mechanism for delivering material to the hopper will be deactuated.

Before operating the machine, the operator first places a bag on the chute presently located at the load-unload station. He does this simply by slipping the open bag end upwardly over the chute to locate the open end above clamp plates 53. The weight of plates 53 clamps the bag to the chute. The operator then actuates start switch 102 to initiate an operational cycle.

Upon receiving an impulse from start switch 102, the container receiving means 19 pivots until the empty container held on chute 50 is located directly below the charging tube 17. At this point one of two limit switches 110 or 111 is operated to open the receiving means rotating circuit and energize a bag enclosure circuit. As this happens, motor 66 is operated to move rack 50 forwardly to close clam plates 63 about the empty container.

When the container is enclosed within enclosure means 21, a clam plate closed switch 108 is actuated to open the enclosure circuit and initiate a timed operation of feed screw 36. After this time is elapsed, the screw feed circuit will open and a compactor circuit will close. With activation of the compactor circuit, motor 98 is operated to bring piston 85 downwardly, compressing the material from charging tube 17 downwardly into the container held within the enclosure means 21.

As the piston 85 moves downwardly, about three fourths of the total length of its stroke, limit switch 107 is operated. This switch opens the "piston down" for a short time delay (approximately 1–2 seconds). After the delay the piston continues its downward movement until another switch 109 is operated to again open the "piston down" circuit. Simultaneously, the enclosure means 21 is operated to open clam plates 63 to the open condition. The piston remains in the down position during this time and until the next cycle is initiated. As the plates come to a fully open position, the cycle is complete and the machine will not cycle again until actuated by the operator.

While the first bag is being filled with the cellulose material, the operator is free to place a second bag over the remaining chute 50. Thus, when the first bag has been filled and the machine completes its cycle, the operator may again throw start switch 102 to initiate another cycle. As this happens, the container receiving means 19 is rotated again, only in an opposite direction, to bring the second container into alignment with the charging tube 17 and the filled container to one of the loading and unloading stations. The operator may then remove the filled container from the chute 50 and replace it with an empty container.

The filled container is removed from the machine simply by operating the lever mechanism 52 to release clamp plates 53. This readies the chute for reception of the next successive bag which may be placed while the other bag is being filled. The operator may progress at any desired pace since he alone can actuate the fill cycle.

It may have become obvious from the above disclosure and attached drawings that various changes and modifications may be made therein. It is not however intended that this disclosure be taken as placing any restrictions upon the scope of the present invention. Only the following claims are to be taken as limitations and definitions of the scope of our invention.

What we claim is:

1. Apparatus for packing low density cellulose fibrous loose fill type building insulation material into flexible containers without forming lumps, comprising:

a supporting framework;

a hopper on the framework adapted to receive a bulk quantity of the cellulose insulation material;

an upright charging tube on the framework for receiving insulation material; said upright charging tube having a downwardly extending open discharge end;

container receiving means on the framework directly below the downwardly extending open discharge end of the charging tube for receiving and supporting an open end of a flexible container in open communication with the downward extending open discharge end of the charging tube;

enclosure means on the framework below the charging tube having a preselected interior shape for releasably encircling the flexible container to form a mold about the flexible container;

a feed screw rotatably mounted within the hopper and in operative communication with the charging tube to withdraw insulation material from the hopper and convey the insulative material to the charging tube;

selectively operable drive means operatively connected to the feed screw for rotating the feed screw at a prescribed speed for a preset time period to withdraw a preselected amount of insulation material from the hopper;

a ribbon screw blender rotatably mounted in the hopper above the feed screw;

a drive means operatively connected to the ribbon screw blender for rotating the blender to agitate the insulation material within the hopper and maintaining the feed screw full of insulation material of a constant density;

compactor means on the framework and operatively connected to the charging tube for pushing the prescribed amount from the charging tube downward into the open flexible container and compressing the insulation material in the flexible container against the encircling enclosure means to form a filled flexible container of compressed insulation material having an exterior shape conforming to the interior shape of the enclosure means; and control means operatively connected to and operating: (1) said enclosure means to encircle said flexible container on said receiving means; (2) said feed screw drive means and said ribbon screw blender drive means to convey the preselected amount of insulation material from said hopper to said discharge tube; (3) said compactor means to push the preselected amount of insulation material through the discharge end of the discharge tube and compress the insulation material in the flexible container against said enclosure means and; (4) said enclosure means to release the encircled flexible container to enable the container to be removed.

2. The packing apparatus as defined in claim 1 wherein the container receiving means includes two spaced contained receiving chutes, each adapted to receive and support a flexible container; said container receiving means being movable to sequentially position the container receiving chutes directly below the open discharge end of the charging tube; and wherein said packing apparatus further includes a drive means operatively connected to the container receiving means for selectively moving the container receiving means to sequentially position the container receiving chutes directly below the open discharge end of the charging tube.

3. The apparatus as defined in claim 2 wherein the open discharge end of the charging tube has a bearing surface means thereon for sliding freely over the container receiving means as the container receiving means is being moved to alternately position the chutes directly below the open discharge end of the charging tube.

4. The packing apparatus as defined in claim 1 wherein the apparatus further comprises a vacuum pressure means operatively connected to the charging tube to provide a vacuum pressure within the charging tube for removing air from the charging tube as the prescribed amount of insulation material is being pushed downward and compressed in the flexible container.

5. The apparatus as defined in claim 1 wherein the hopper includes a hollow chamber defined by downwardly diverging side walls.

6. The apparatus as defined in claim 1 wherein the container enclosure means include a pair of clam plates mounted on the framework for movement from a closed position in which the clam plates encircle the flexible container to an open position in which the clam plates are spread apart to enable a packed container to be removed from the apparatus and drive means operatively connected to the clam plates for selectively moving the clam plates between the closed position and the open position.

7. The apparatus as defined in claim 1 wherein the compactor means includes a drive means operatively connected to the piston means for moving the piston downward through a preselected stroke; and wherein said control means is operatively connected to the piston drive means and responsive to the downward movement of the piston for selectively operating the piston drive means to initially move the piston means downwardly to an intermediate position less than the preselected stroke and stop the piston means at the intermediate position for a preselected time period and then at the termination of the preselected time period continue the downward movement of the piston means to a final down position.

8. A machine for packing low density cellulose fibrous loose fill type building insulation material into flexible containers, comprising:

a supporting framework;

a hopper on the framework adapted to receive a bulk quantity of the cellulose insulation material;

an upright charging tube on the framework at a container filling station for receiving insulation material; said upright charging tube having a downwardly extending open discharge end;

container receiving means on the framework having two spaced container receiving chutes for receiving and supporting flexible containers;

said container receiving means being movably mounted on the framework for shifting the container receiving chutes alternately between the container filling station and a container loading and unloading station;

first drive means for selectively moving the container receiving means to alternately shift the container receiving chutes between the container filling station and the container loading and unloading station;

a feed screw rotatably mounted in the hopper and in operative communication with the charging tube to withdraw cellulose insulation material from the hopper and convey the material to the charging tube;

second drive means operatively connected to the feed screw for selectively rotating the feed screw at a prescribed speed for a preset time period to withdraw a preselected amount of insulation material from the hopper and convey the withdrawn amount of material to the charging tube;

a piston means mounted on the framework for reciprocal movement within the charging tube;

third drive means operatively connected to the piston means for selectively reciprocating the piston means to push the prescribed amount of material conveyed to the charging tube downward through the discharge end and into the flexible container at the container filling station and to compress the material in the flexible container;

vacuum pressure means operatively connected to the charging tube to provide a vacuum pressure within the charging tube for removing air from the charging tube as the prescribed amount of insulation is being pushed downward and compressed in the flexible container;

clam plate means mounted on the framework at the container filling station for movement between a closed position in which the clam plate means encircle a flexible container forming a mold and an open position in which a flexible container may be moved from the filling station;

fourth drive means operatively connected to the clam plate means between the closed and open position;

control means operatively connected to the first, second, third and fourth drive means for selectively operating: (1) the first drive means to move the container receiving means to shift one chute supporting an empty flexible container from the loading and unloading station to the filling station for filling and to shift the other chute from the filling station to the loading and unloading station to receive a successive empty flexible container; (2) the fourth drive means to move the clam plate means to the closed position encircling the empty flexible container at the filling station; (3) the second drive means to withdraw the prescribed amount of insulation material from the hopper and convey the material into the charging tube; (4) the third drive means to push the amount of insulation material downward through the discharge end of the charging tube and through the chute at the filling station and compressing the insulation in the flexible container against the encircling clam plate means to form a filled flexible container of compressed insulation material; and (5) the fourth drive means to move the clam plate means to the open position to enable the filled container to be removed from the filling station.

9. The machine as defined in claim 8 wherein the control means is responsive to the downward movement of the piston and further selectively operates the third drive means initially moving the piston downward to an intermediate position and stopping the piston for a preselected time period and then continuing the downward movement of the piston to a terminal down position.

* * * * *